US009541313B2

(12) United States Patent
Ikeda et al.

(10) Patent No.: US 9,541,313 B2
(45) Date of Patent: Jan. 10, 2017

(54) REFRIGERATING DEVICE

(75) Inventors: Takashi Ikeda, Tokyo (JP); Tomotaka Ishikawa, Tokyo (JP); Hiroshi Sata, Tokyo (JP); Fumitake Unezaki, Tokyo (JP)

(73) Assignee: MITSUBISHI ELECTRIC CORPORATION, Chiyoda-ku, Tokyo (JP)

( * ) Notice: Subject to any disclaimer, the term of this patent is extended or adjusted under 35 U.S.C. 154(b) by 590 days.

(21) Appl. No.: 13/259,290

(22) PCT Filed: Mar. 11, 2010

(86) PCT No.: PCT/JP2010/001742

§ 371 (c)(1),
(2), (4) Date: Sep. 23, 2011

(87) PCT Pub. No.: WO2010/113395

PCT Pub. Date: Oct. 7, 2010

(65) Prior Publication Data

US 2012/0006041 A1 Jan. 12, 2012

(30) Foreign Application Priority Data

Mar. 31, 2009 (JP) ..... 2009-086191

(51) Int. Cl.
*F25B 31/00* (2006.01)

(52) U.S. Cl.
CPC ..... *F25B 31/004* (2013.01); *F25B 2400/075* (2013.01)

(58) Field of Classification Search
CPC ... F25B 31/004; F25B 2400/75; F25B 31/002; F25B 2700/03; F25B 2500/16
(Continued)

(56) References Cited

U.S. PATENT DOCUMENTS 3,248,895 A * 5/1966 Mauer ..... F24F 11/085 62/157
4,779,427 A * 10/1988 Rowley ..... F02G 1/04 62/116
(Continued)

FOREIGN PATENT DOCUMENTS

JP 01127865 A * 5/1989
JP 9-72636 A 3/1997
(Continued)

OTHER PUBLICATIONS

International Search Report (PCT/ISA/210) issued on Apr. 6, 2010, by Japanese Patent Office as the International Searching Authority for International Application No. PCT/JP2010/001742.
(Continued)

*Primary Examiner* — Allana Lewin Bidder
*Assistant Examiner* — Kun Kai Ma
(74) *Attorney, Agent, or Firm* — Buchanan Ingersoll & Rooney PC

(57) ABSTRACT

A refrigerating device that forms a refrigerating cycle in which a plurality of outdoor machines 1*a* and 1*b* provided at least with compressors 2*a* and 2*b*, condensers 4*a* and 4*b*, and accumulators 5*a* and 5*b* respectively and an indoor machine 20 provided with decompressing means 21 and an evaporator 22 are connected in parallel by piping, having oil return pipes 13*a* and 13*b* that return refrigerator oil stored in the accumulators into the compressors, an oil equalizing pipe 10 that connects the accumulators to each other, and a controller 30 that controls an operation of the compressor and on/off of an electromagnetic valve 12*a* deposed on the oil equalizing pipe.

9 Claims, 3 Drawing Sheets

(58) Field of Classification Search
USPC ..... 62/84, 192, 193, 468
See application file for complete search history.

(56) References Cited

U.S. PATENT DOCUMENTS

| | | | | | |
|---|---|---|---|---|---|
| 4,870,831 | A * | 10/1989 | Kitamoto | 62/84 | |
| 4,912,937 | A * | 4/1990 | Nakamura | F24F 1/022 | 62/160 |
| 5,369,958 | A * | 12/1994 | Kasai | F24F 3/065 | 62/158 |
| 5,575,303 | A * | 11/1996 | Hulbert | G05B 11/32 | 137/1 |
| 5,901,559 | A * | 5/1999 | Westermeyer | G01F 23/74 | 417/12 |
| 6,453,697 | B1 * | 9/2002 | Harmer | B21D 51/30 | 220/618 |
| 2002/0023459 | A1 * | 2/2002 | Kiyokawa et al. | 62/469 | |
| 2003/0066302 | A1 * | 4/2003 | Ueno | 62/192 | |
| 2004/0231357 | A1 * | 11/2004 | Matsuoka et al. | 62/470 | |
| 2005/0081537 | A1 * | 4/2005 | Hwang | F25B 13/00 | 62/84 |
| 2005/0092000 | A1 * | 5/2005 | Hwang | F25B 31/004 | 62/193 |
| 2005/0103048 | A1 * | 5/2005 | Kim et al. | 62/510 | |
| 2006/0117776 | A1 * | 6/2006 | Choi et al. | 62/228.5 | |
| 2006/0123835 | A1 * | 6/2006 | Takegami et al. | 62/498 | |
| 2007/0000276 | A1 * | 1/2007 | Tso | F25B 13/00 | 62/324.1 |
| 2008/0267804 | A1 * | 10/2008 | Morozumi | 418/60 | |
| 2009/0277213 | A1 * | 11/2009 | Sakitani | F25B 9/06 | 62/470 |

FOREIGN PATENT DOCUMENTS

| | | | | |
|---|---|---|---|---|
| JP | 10-2626 | A | | 1/1998 |
| JP | 11014200 | A | * | 1/1999 |
| JP | 2001-201192 | A | | 7/2001 |
| JP | 2001289519 | A | * | 10/2001 |
| JP | 2002-327975 | A | | 11/2002 |
| JP | 2005-127703 | A | | 5/2005 |
| JP | 3930654 | B2 | | 3/2007 |
| JP | 3937884 | B2 | | 4/2007 |

OTHER PUBLICATIONS

Office Action (Notification of the Second Office Action) issued on Sep. 24, 2013 by the Chinese Patent Office in corresponding Chinese Patent Application No. 201080015354.3 and an English Translation of the Office Action. (7 pages).

Chinese Office Action (PCT Application in the National Phase) dated Feb. 5, 2013, issued by the Chinese Patent Office in corresponding Chinese Patent Application No. 201080015354.3 and English translation. (8 pages).

* cited by examiner

REFRIGERATING DEVICE

TECHNICAL FIELD

The present invention relates to a refrigerating device provided with a multiple outdoor machine that uses a plurality of outdoor machine units in combination and particularly to a configuration of an oil circuit that prevents uneven distribution of refrigerator oil among the outdoor machine units constituting the multiple outdoor machine and operation control thereof.

BACKGROUND ART

Methods of appropriately supplying oil (refrigerator oil) to a plurality of compressors include use of a refrigerating device described in Japanese Patent No. 3937884 (Patent Literature 1), for example. This refrigerating device is constructed by a refrigerating cycle in which a plurality of compressors connected in parallel, a condenser, a decompressor, an evaporator, and an accumulator are serially connected, provides an oil recovering circuit that recovers excess refrigerator oil in the compressor into the accumulator, holds the refrigerator oil circulating through the refrigerating cycle in the accumulator and provides an operation controller that stops an operation of a target compressor when an oil recovering operation for recovering the refrigerator oil in the compressor into the accumulator. Alternatively, an oil return circuit that supplies the refrigerator oil in the accumulator to the compressor is provided.

On the other hand, in the refrigerator, it is demanded to increase in refrigerating capacity, and it has been considered to increase in capacity by combining a plurality of existing refrigerators in order to realize to increase in capacity easily and inexpensively.

As means for satisfying the above demand, as in illustrated in Japanese Patent No. 3930654 (Patent Literature 2), a use of a multiple-unit refrigerator provided with one or a plurality of compressors for one outdoor unit in a form in which a plurality of outdoor units are connected in parallel by piping between the units, extending from the outdoor units, has been considered. Moreover, an oil tank that stores oil separated by an oil separator from a high-pressure gas refrigerant discharged from the compressor is made to flow through each outdoor unit in order to equalize oil.

CITATION LIST

Patent Literature

Patent Literature 1: Japanese Patent No. 3937884 (FIG. 1)
Patent Literature 2: Japanese Patent No. 3930654 (FIG. 1)

SUMMARY OF INVENTION

Technical Problem

When the configuration of a large-capacity refrigerator is to be used in a form in which a plurality of outdoor units are connected in parallel, if they are simply connected with each other, oil distribution becomes uneven, which causes a problem that oil is gradually decreased in an outdoor unit in which an oil distribution amount is less, the oil soon becomes depleted and the compressor of the corresponding outdoor unit is broken. To cope with this problem, as illustrated in Patent Literature 1, if an accumulator, which is the only oil storage portion, is connected to a plurality of compressors and the accumulators of the respective outdoor machines are unified, the accumulator cannot be used in common with the conventional outdoor machines which are used singularly. Though a method in communication of the oil storage portions installed on the high pressure side of each outdoor machine each other is also disclosed in Patent Literature 2, if the oil storage portion is installed on the low pressure side, a driving force to fluidize the oil is decreased, and equalizing of the oil is difficult, which is a problem.

In consideration of the above conventional problems, the present invention aims to provide a refrigerating device that improves reliability of a refrigerator operation by avoiding oil depletion of a specific outdoor unit and by operating so as to equalize and supply oil to all the compressors when a large-capacity refrigerator provided with an oil storage portion on the low pressure side is constructed and that can be realized inexpensively by combining existing refrigerators.

Solution to Problem

A refrigerating device of the present invention is a refrigerating device that forms a refrigerating cycle in which a plurality of outdoor machines, each provided at least with a compressor, a condenser and an accumulator, and an indoor machine provided with decompressing means and an evaporator are connected in parallel by piping, having an oil return pipe that returns refrigerator oil stored in said accumulator to said compressor, an oil equalizing pipe that connects the accumulators to each other, and a controller that controls an operation of said compressor and on/off of an electromagnetic valve deposed on said oil equalizing Pipe.

Advantageous Effects of Invention

In the present invention, since the oil return pipes that return the refrigerator oil stored in the accumulators to the compressor, the oil equalizing pipe that connects the accumulators to each other, and the controller that controls the operation of the compressor and the on/off of the electromagnetic valve deposed on the oil equalizing pipe are provided, the refrigerator oil can be equalized and supplied to the compressors of all the outdoor machines, and oil depletion of the compressor can be prevented. Also, the refrigerating device can be inexpensively realized by combining conventional refrigerators.

DESCRIPTION OF EMBODIMENTS

Embodiments of a refrigerating device according to the present invention will be described below by referring to the attached drawings.

Embodiment 1

Figure 1:
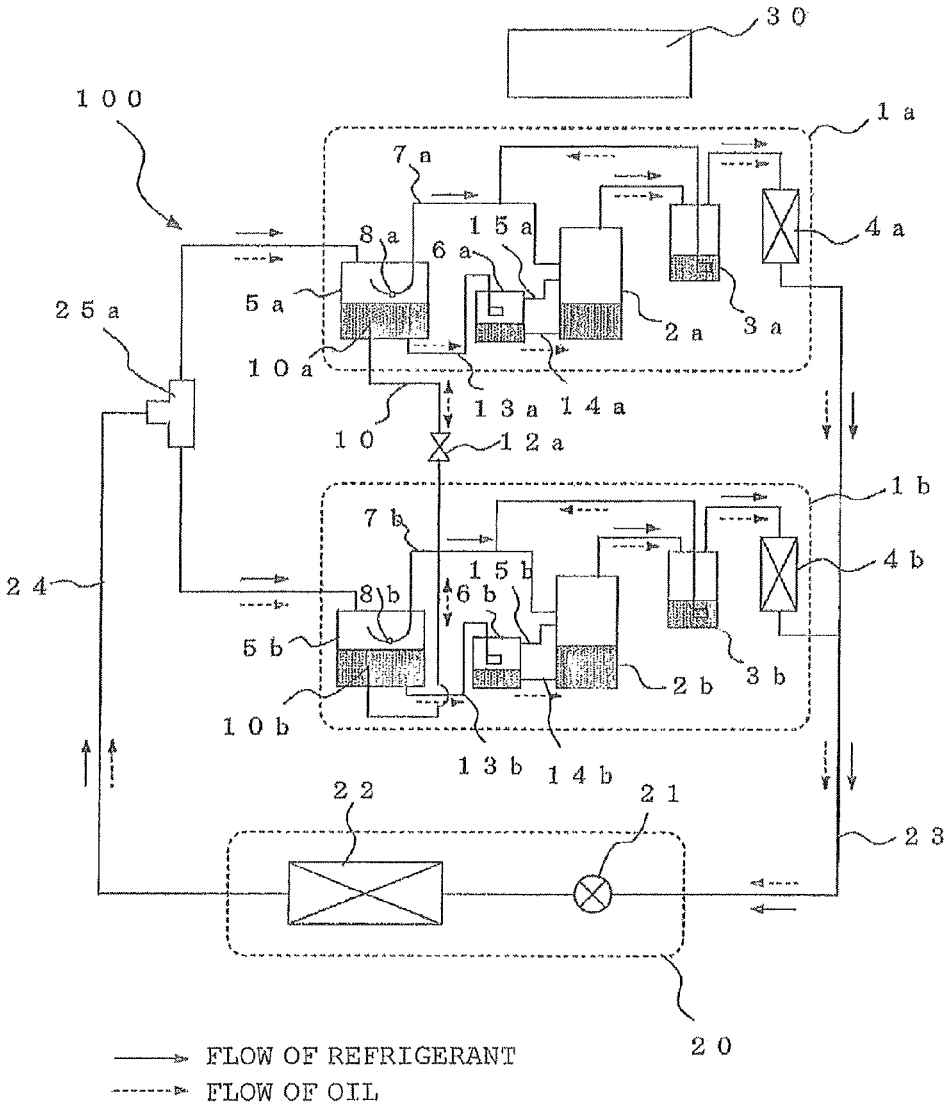
FIG. 1 is a refrigerant circuit diagram of a refrigerating device illustrating Embodiment 1 of the present invention.

FIG. 1 is a refrigerant circuit diagram of a refrigerating device 100 according to Embodiment 1 of the present invention.

The refrigerating device 100 of Embodiment 1 is provided with a plurality of (two in this example) outdoor machines (also referred to as outdoor units) 1*a* and 1*b*, and the outdoor machines 1*a* and 1*b* are connected in parallel with an indoor machine (also referred to as indoor units) 20, which is usually plural, having an expansion valve 21 that is decompressing means and an evaporator 22 by means of a liquid pipeline 23 and a gas pipeline 24. The outdoor machines 1*a* and 1*b* are provided with compressors 2*a* and 2*h*, oil separators 3*a* and 3*b*, condensers 4*a* and 4*b*, accumulators 5*a* and 5*b*, and oil regulators 6*a* and 6*b*, respectively. By connecting the condensers 4*a* and 4*b* to the liquid pipeline 23 leading to the expansion valve 21 and by connecting the accumulators 5*a* and 5*b* to the gas pipeline 24 from the evaporator 22 via a distributor 25*a*, a refrigerating cycle is formed through which a refrigerant and the refrigerator oil contained in the refrigerant circulate.

The accumulators 5*a* and 5*b* are connected to each other by an oil equalizing pipe 10 in order to prevent uneven distribution of oil amounts stored in the individual accumulator. In the oil equalizing pipe 10, an electromagnetic valve 12*a* that opens/closes communication of the oil is provided. Here, end portions 10*a* and 10*b* of the equalizing pipe 10 penetrate through and are inserted into the bottom portions of the accumulators 5*a* and 5*b*, respectively, and end inlet of the oil equalizing pipe 10 is installed at a predetermined height from (the same height as) the bottom face of each of the accumulators 5*a* and 5*b*. As a result, a minimum oil amount that surely stores in the accumulators 5*a* and 5*b* all the time can be set. Also, a gas refrigerant (including refrigerator oil that could not be separated) in the accumulators 5*a* and 5*b* is sucked into the compressors 2*a* and 2*b* via gas intake pipes 7*a* and 7*b*. The gas intake pipes 7*a* and 7*b* have one ends, which are to be inserted into the accumulators 5*a* and 5*b*, formed in the U-shape, and the U-shaped pipe portions have oil return holes 8*a* and 8*b*, respectively. Moreover, oil return pipes 13*a* and 13*b* that return the oil stored in the accumulators 5*a* and 5*b* to the compressors 2*a* and 2*b* have one ends that penetrate through and connect to the bottom portion of the accumulators 5*a* and 51, while the other ends are connected to the oil regulators 6*a* and 6*b*.

The oil regulators 6*a* and 6*b* and the compressors 2*a* and 2*b* are connected by oil intake pipes 14*a* and 14*b* and pressure equalizing pipes 15*a* and 15*b* respectively. Inside the oil regulators 6*a* and 6*b*, float valves (not shown) interlocking with floats are provided. If the oil level is not more than the specified height, the float valve is opened, and the oil is supplied to the compressors 2*a* and 2*b*. If the oil level reaches the specified height, the float valve is shut off so that oil supply to the compressors 2*a* and 2*b* is stopped. The oil separated by the oil separators 3*a* and 3*b* and stored is returned to the compressors 2*a* and 2*b* via the gas intake pipes 7*a* and 7*b* through capillary tubes, not shown, or directly without passing through the capillary tubes. Reference numeral 30 denotes a controller that controls operations of the compressors 2*a* and 2*b* and opening/closing of the electromagnetic valve 12*a* provided in the oil equalizing pipe 10.

The compressors 2*a* and 2*b* are inverter-type compressors of a low-pressure shell type, in which the inside of a shell such as a scroll is at a low pressure, and has a structure in which the refrigerator oil is held in the compressor shell. Also, in this refrigerating device 100, a required oil amount is an amount obtained by totaling the appropriate oil amount in the compressors 2*a* and 2*b* and the oil amount present in each part of the refrigerating device 100, and as an oil amount to be filled, an oil amount larger than this oil amount is filled in advance. The extra oil is stored in the accumulators 5*a* and 5*b*. In the oil stored in the compressors 2*a* and 2*b*, an amount of oil taken out from the compressor rapidly increases to the oil level or more, and a compression load is increased. Thus, the appropriate oil amounts in the compressors 2*a* and 2*b* become an oil level corresponding to a sufficient oil amount at which the amount of oil taken out does not rapidly increase and the oil does not become depleted. Also, a refrigerant and a refrigerator oil that are soluble with each other are used. For example, in case that the refrigerant is R22, mineral oil is used as the refrigerator oil, and in case that the refrigerant is R404A or R410A, ester oil is used as the refrigerator oil.

Subsequently, a flow of the refrigerant in the refrigerating device 100 in Embodiment 1 will be described. The flow of the refrigerant is shown by a solid-line arrow in FIG. 1.

A high-temperature high-pressure gas refrigerant discharged from the compressors 2*a* and 2*b* is condensed and liquefied by the condensers 4*a* and 4*b* via the oil separators 3*a* and 3*b* and then, is decompressed by the expansion valve 21 of the indoor machine 20 via the liquid pipeline 23 and turns into a two-phase refrigerant, is evaporated and gasified by the evaporator 22 and then, enters into the accumulators 5*a* and 5*b* of each of the outdoor machines 1*a* and 1*b* via the gas pipeline 24 and the distributor 25*a* and moreover, the evaporated and gasified refrigerant is sucked into the compressors 2*a* and 2*b* via the gas intake pipes 7*a* and 7*b*, forms a circulating refrigerating cycle so that the refrigerant and refrigerator oil circulates.

Subsequently, a flow of the refrigerator oil in the refrigerating device 100 in Embodiment 1 will be described. The flow of the refrigerator oil is shown by a broken-line arrow in FIG. 1.

Approximately 90% of the refrigerator oil discharged together with the gas refrigerant from the compressors 2*a* and 2*b* is separated at the oil separators 3*a* and 3*b*. The separated refrigerator oil enters the gas intake pipes 7*a* and 7*b* via the capillary tube (not shown) and the like and is returned to the compressors 2*a* and 2. The oil not separated in the oil separators 3*a* and 3*b* flows into the accumulators 5*a* and 5*b* through the condensers 4*a* and 4*b*, the liquid pipeline 23, the expansion valve 21, the evaporator 22, the gas pipeline 24, and the distributor 25*a*. In the accumulators 5*a* and 5*b*, the refrigerator oil and the gas refrigerant are separated from each other, and the separated oil is collected in the bottom portions of the accumulators 5*a* and 5*b*. The refrigerator oil collected in the accumulators 5*a* and 5*b* is supplied to the compressors 2*a* and 2*b* from the oil return pipes 13*a* and 13*b* via the oil regulators 6*a* and 6*b*. In order to make the oil levels of the oil regulators 6*a* and 6*b* equal to those of the compressors 2*a* and 2*b*, the pressure equalizing pipes 15*a* and 15*b*, though which the gas flows, are connected. The extra oil in the refrigerating device is collected in the accumulators 5*a* and 5*b* of a low-pressure part.

In the flow of the refrigerant from the accumulators 5*a* and 5*b* to the compressors 2*a* and 2*b*, pressure loss caused by frictional loss in the pipeline occurs. The differential pressure of this pressure loss is to be a driving force with which the oil flows from the accumulators 5*a* and 5*b* to the compressors 2*a* and 2. A difference in the oil level heads generated by a difference between the oil levels in the accumulators 5*a* and 5*b* and the oil levels in the compressors 2*a* and 2*b* affects the flow of oil. If the oil levels of the accumulators 5*a* and 5*b* are higher than the oil levels of the compressors 2*a* and 2*b*, oil supply is accelerated, while if they are lower, the oil supply is disturbed.

The oil not having been separated in the oil separators 3*a* and 3*b* circulates through the refrigerant circuit and flows into the outdoor machines 1*a* and 1*b* again. However, if there are a plurality of outdoor machines, oil is not evenly distributed in general and amounts of oil to be returned are different among the outdoor machines. If the refrigerating device 100 of the present embodiment is operated for a long hours, stored amounts of excess oil in the accumulators 5*a* and 5*b* become different, and the oil in one of the accumulators might become depleted. If the oil in the accumulator 5*a* is depleted, for example, the oil in the compressor 2*a* is also depleted, which causes breakage of the compressor.

A method of equalizing oil in order to avoid compressor breakage caused by oil unevenly distributed among the outdoor machines will be described. The oil equalizing pipe 10 is connected between the accumulator 5*a* and the accumulator 5*b* via the electromagnetic valve 12*a*. Moreover, inflow port positions (end positions) of the end portions 10*a* and 10*b* of the oil equalizing pipe 10 are set at a predetermined height from the bottom face of each of the accumulators 5*a* and 5*b*.

During a usual operation of the compressors 2*a* and 2*b*, the electromagnetic valve 12*a* of the oil equalizing pipe 10 is closed, and the compressors are operated with the oil equalizing pipe 10 that connects the accumulators 5*a* and 5*b* closed. At this time, if the float valves of the oil regulators 6*a* and 6*b* are open, the oil is sucked into the compressor 2*a* and 2*b*, and thus, the oil in the accumulators 5*a* and 5*b* flows through the oil return pipes 13*a* and 13*b* and is returned from the oil regulators 6*a* and 6*b* to the compressors 2*a* and 2*b*. However, since the oil is not returned evenly to the compressors 2*a* and 2*b*, the oil in the accumulators 5*a* and 5*b* are unevenly distributed, and it is expected that one of the accumulator might become oil depleted. Thus, in order to avoid breakage of the compressor caused by oil depletion in the accumulator, an oil equalizing operation is performed subsequent to the usual operation of the compressors 2*a* and 2*b*. That is, the usual operation of the compressors 2*a* and 2*b* is performed for a predetermined time and the oil equalizing operation is performed in order to decrease the uneven distribution of the oil in the accumulators 5*a* and 5*b* before the oil is depleted. This oil equalizing operation is performed by the controller 30 in as short a time as possible. The compressor does not necessarily have to be stopped during the oil equalizing operation, but it may be performed after the compressor is stopped. The oil equalizing operation method will be described later.

Also, if the float valve of a certain oil regulator is shut off, oil is unevenly distributed in the accumulators 5*a* and 5*b*. When oil is unevenly distributed in the outdoor machine 1*a* and the oil level in the oil regulator 6*a* reaches a specified height and the float valve is shut off, for example, the oil in the accumulator 5*b* is supplied to the compressor 2*b* via the oil return pipe 13*b* and the oil regulator 6*b*, and the oil in the accumulator 5*b* begins to become depleted. Thus, the oil equalizing operation is performed before the oil is depleted.

Methods of determining the timing at which to start the oil equalizing operation are (1) a method of determining the timing using an elapsed time of a usual operation; and (2) a method of determining the timing using a total frequency (total of driving frequencies of the compressors) of the compressors 2*a* and 2*b*. In both (1) and (2), the oil equalizing operation is started when the elapsed time or the total frequency reaches a set value or more.

Also, the oil equalizing operation might involve control of an oil return mode. The oil return mode is an operation mode in which oil remained outside the outdoor machine system (indoor machines, extension pipelines and the like) is recovered, and the oil is recovered by stopping the compressor related to oil depletion and circulating the refrigerant.

Here, the oil equalizing operation method will be described. During the oil equalizing operation, the electromagnetic valve 12*a* of the oil equalizing pipe 10 is opened, and the oil equalizing operation is performed with the oil equalizing pipe 10 that connects the accumulators 5*a* and 5*b* to each other opened. As described above, if the oil in the accumulator 5*b* will become depleted, for example, excess oil in the accumulator 5*a* flows to the accumulator 5*b* via the oil equalizing pipe 10, and the oil amounts in the accumulators 5*a* and 5*b* are made equal. Therefore, breakage by oil depletion can be avoided.

Also, since the accumulators 5*a* and 5*b* are connected to each other only by the oil equalizing pipe 10 provided with the electromagnetic valve 12*a*, they can be used in common with the conventional outdoor machines used singularly, and reliable operation of the refrigerating device 100 can be performed.

Also, since the oil equalizing pipe 10 extends over the outdoor machines 1*a* and 1*b*, its length is longer than that of the oil return pipes 13*a* and 13*b*). Thus, the pipeline diameter of the oil equalizing pipe 10 is made to be larger than that of the oil return pipes 13*a* and 13*b*, whereby frictional loss in the oil flow of the oil equalizing pipe 10 is reduced. By means of this action, the flow rate of oil flowing through the oil equalizing pipe 10 is increased, and time required for oil equalizing between the accumulators 5*a* and 5*b* can be reduced.

Also, the accumulators 5*a* and 5*b* are installed at higher positions than the compressors 2*a* and 2*b*, if the oil levels of the accumulators 5*a* and 5*b* are higher than the compressors 2*a* and 2*b*, the flow rate of oil flowing through the oil equalizing pipe 10 is increased, whereby reduction of the oil equalizing operation time can be promoted. Moreover, since the pipeline diameter of the required oil passage can be made small, an amount of oil required to be filled in the refrigerating device can be reduced.

Subsequently, an oil-amount relationship between the compressors 2*a* and 2*b* and the accumulators 5*a* and 5*b*, which are essential parts of the present invention, will be described by using FIG. 2. Numeric values shown below are only examples and intended for facilitation of understanding.

Figure 2:
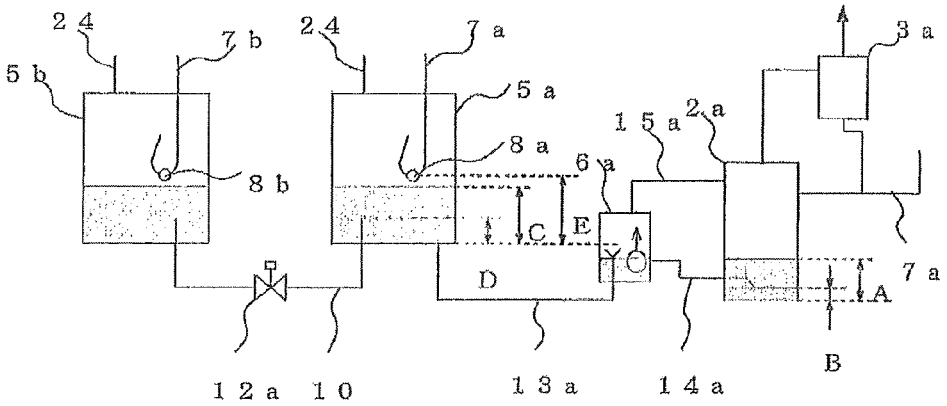
FIG. 2 is a circuit diagram illustrating a connection relationship between an accumulator and a compressor, which are essential parts of the present invention.

FIG. 2 shows a major connection relationship of one of the compressors or the compressor 2*a*, for example, but the same also applies to the other compressor 2*b*. Unless specified otherwise, the compressor 2*a* will be described in the following.

First, an initial oil amount A of the compressor 2*a* is 1.8 L, (abbreviation for liter. The same applies to the following). A critical oil amount B is 0.5 L, and the oil regulator 6*a* has 0.5 L at this time.

An initial oil amount C in the accumulator 5*a* (the same applies to the accumulator 5*b*) is 4.5 L, and a height ID of the oil equalizing pipe 10 is set at the position of 2 L. Also, a height E of the oil return hole 8*a* in the gas intake pipe 7*a* is at the position of 5.2 L, and it is so configured that when coming up to 5.2 L or more, the oil is sucked through the oil return hole 8*a* and returned to the compressor 2*a*. The lowest portion (bottom-face height) of the accumulator 5*a* is set at the height of the pipeline (the oil return pipe 13*a*) that connects the accumulator 5*a* and the oil regulator 6*a* to each other or higher.

Table 1 shows an example of a result of examination on a remaining amount of the stored oil of an accumulator (Acc) when control time (operation time interval) and a compressor driving frequency are changed in simulation of the oil equalizing operation. In the simulation, conditions under which oil in the outdoor machine 1*a* is depleted most easily are set, for example.

TABLE 1

| Control time | Frequency (Hz) | Acc remaining amount (L) | Rated as |
|---|---|---|---|
| 6 minutes per 120 minutes | 110/35 | 1 | Good |
| | 80/30 | 0 | Bad |
| | 60/0 | 0 | Bad |
| 3 minutes per 60 minutes | 110/35 | 1 | Good |
| | 90/45 | 1 | Good |

In Table 1, "6 minutes per 120 minutes", for example, means that the oil equalizing operation is successively performed for 6 minutes after 120 minutes of the usual operation. The frequency of "110/35", for example, means that the compressor is operated at the frequency of 110 Hz during the usual operation and at 35 Hz during the oil equalizing operation.

The control time and the compressor operation frequency can be acquired from Table 1 so that the oil amount 4.5 L to the minimum of 1 L can be ensured all the time in the accumulator 5*a*.

Table 2 shows a result of the remaining amount in the accumulator 5*a* when the oil equalizing pipe position (position of the end inflow port) of the accumulator 5*a* is changed from 1 L to 4 L under a condition of the control time of 6 minutes per 120 minutes.

TABLE 2

| Control time | Acc oil equalizing pipe position (L) | Acc remaining amount (L) | Rated as |
|---|---|---|---|
| 6 minutes per 120 minutes | 1.0 | 0 | Bad |
| | 2.0 | 1 | Good |
| | 3.0 | 0 | Bad |
| | 4.0 | 0 | Bad |

Table 2 shows it is optimal that the position of the end inflow port position of the oil equalizing pipe 10 is the position of 2 L. The remaining amount in the accumulator 5*a* becomes 0 in other cases when the end inflow port positions of the oil equalizing pipe 10 are 1 L, 3 L, and 4 L. Since the optimal end inflow port position of the oil equalizing pipe 10 is determined also by the capacity of the accumulator, a conclusion cannot be readily made, but under the condition that at least 1 L is ensured all the time, the position at the height of 40 to 60% of the capacity of the accumulator is considered to be favorable.

Figure 3:
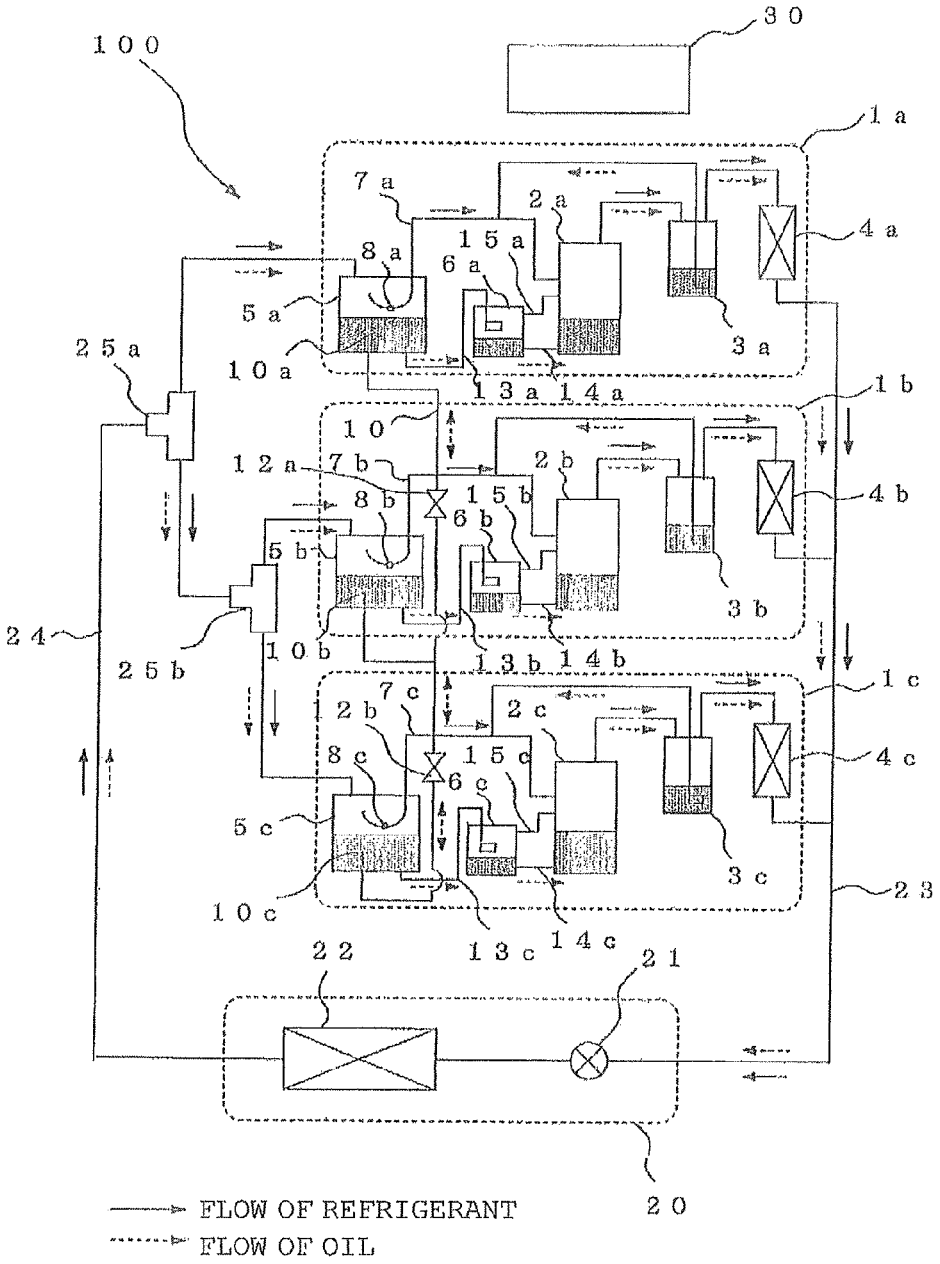
FIG. 3 is a refrigerant circuit diagram of a refrigerating device illustrating Embodiment 2 of the present invention.

Table 3 shows an example of the driving frequency of each outdoor machine during the oil equalizing operation when three outdoor machines 1*a*, 1*b*, and 1*c* are connected in parallel as shown in FIG. 3, for example. In FIG. 3, since the constituent components of the outdoor machine 1*c* are the same as those of the outdoor machines 1*a* and 1*b*, reference characters c or b are attached to the numerals in order indicating each constituent component. The flows of the refrigerant and the refrigerating oil are the same as in FIG. 1.

TABLE 3

| | Oil equalizing operation driving frequency of outdoor machine | | |
|---|---|---|---|
| Control time | No. 1 | No. 2 | No. 3 |
| 1 Hr/3 minutes | 90 | 90 | 45 |
| 2 Hr/3 minutes | 90 | 45 | 90 |
| 3 Hr/3 minutes | 45 | 90 | 90 |

In Table 3, supposing that the usual operation time is 1 hour and the oil equalizing operation time is 3 minutes, for example, the oil equalizing operation after 1 hour is performed with the No. 1 outdoor machine 1*a* and the No. 2 outdoor machine 1*b* at the frequency of 90 Hz and the No, 3 outdoor machine 1*c* at the frequency of 45 Hz, the oil equalizing operation after 2 hours is performed with the No. 1 outdoor machine 1*a* and the No. 3 outdoor machine 1*c* at the frequency of 90 Hz and the No, 2 outdoor machine 1*b* at the frequency of 45 Hz, and the oil equalizing operation after 3 hours is performed with the No, 2 outdoor machine 1*b* and the No. 3 outdoor machine 1*c* at the frequency of 90 Hz and the No. 1 outdoor machine 1*a* at the frequency of 45 Hz. Then, after 4 hours, the mode returns to the initial mode, and the oil equalizing operation is performed with the frequencies same to those in the first hour.

As described above, while all the electromagnetic valves 12*a* and 12*b* are kept open by the controller 30, by executing control in which a specific compressor is operated at a frequency lower than other compressors and the compressor that performs a low-frequency operation is alternated every predetermined time so that all the compressors are operated at the low frequency at least once, the oil amount of the compressor can be adjusted to an appropriate oil amount while it is ensured that the minimum oil amount is in the accumulator all the time. As a result, breakage of the compressor caused by oil depletion can be avoided, and highly reliable operation of the refrigerating device 100 can be performed.

Also, in the operation of the refrigerating device 100 described in Embodiment 1, the same effect can be obtained as long as the refrigerant and the refrigerator oil are a compatible combination. Therefore, similar effects can be obtained even if HFC refrigerants or a mixture of such refrigerants, HC refrigerants and a mixture of such refrigerants or natural refrigerants such as $CO_2$, water and the like are used as a refrigerant, and oil compatible with them such as ester oil in the case of the HFC refrigerants, mineral oil in the case of the HC refrigerants, PAG oil in the case of $CO_2$ and the like are used as oil.

REFERENCE SIGNS LIST

1*a*, 1*b*, 1*c* outdoor machine, 2*a*, 2*b*, 2*c* compressor, 3*a*, 3*b*, 3*c* oil separator, 4*a*, 4*b*, 4*c* condenser, 5*a*, 5*b*, 5*c* accumulator, 6*a*, 6*b*, 6*c* oil regulator, 7*a*, 7*b*, 7*c* gas intake pipe, 8*a*, 8*b*, 8*c* oil return hole, 10 oil equalizing pipe, 10*a*, 10*b*, 10*c* end portion of oil equalizing pipe, 12*a*, 12*b* electromagnetic valve, 13*a*, 13*b*, 13*c* oil return pipe, 14*a*, 14*b*, 14*c* oil intake pipe, 15*a*, 15*b*, 15*c* pressure equalizing pipe, 20 indoor machine, 21 expansion valve, 22 evaporator, 23 liquid pipe, 24 gas pipeline, 25*a*, 25*b* distributor, 30 controller, 100 refrigerating device.

The invention claimed is:

1. A refrigerating device that forms a refrigerating cycle in which a plurality of outdoor machines, each provided at least with a compressor, a condenser and an accumulator, and an indoor machine provided with a decompressor and an evaporator, are connected in parallel by piping, comprising:

an oil return pipe that returns refrigerator oil stored in said accumulator to said compressor;

an oil equalizing pipe that connects the accumulators to each other;

a controller that controls an operation of said compressor and on/off of an electromagnetic valve disposed on said oil equalizing pipe; and an oil regulator that adjusts an oil amount to be supplied to said compressor and is provided between said accumulator and said compressor, wherein said oil return pipe directly connects said accumulator and said oil regulator, said accumulator is disposed at a downstream side of said evaporator in a refrigerant flow of said refrigerating cycle and at an upstream side of said compressor in the refrigerant flow of said refrigerating cycle, said oil return pipe is provided independent from a refrigerant pipeline of said refrigeration cycle so that the oil return pipe does not include refrigerant gas, said controller opens said electromagnetic valve to make amounts of refrigerator oil stored in each of said accumulators equal, and a lowermost portion of the accumulator is disposed at a height not lower than the oil return pipe connected to the accumulator.

2. The refrigerating device of claim 1, wherein an end inflow port of said oil equalizing pipe is disposed at a predetermined height from the bottom face of said accumulator.

3. The refrigerating device of claim 1, wherein a pipeline diameter of said oil equalizing pipe is larger than a pipeline diameter of said oil return pipe.

4. The refrigerating device of claim 1, wherein said accumulator is disposed at a position higher than said compressor so that an oil head difference is generated.

5. The refrigerating device of claim 1, wherein the predetermined height of the end inflow port of the oil equalizing pipe inside the accumulator is at a location corresponding to 40% to 60% of the capacity of the accumulator.

6. The refrigerating device of claim 2, wherein the end inflow port of said oil equalizing pipe is disposed inside said accumulator at the predetermined height from the bottom face of said accumulator.

7. A refrigerating device that forms a refrigerating cycle in which a plurality of outdoor machines, each provided at least with a compressor, a condenser and an accumulator, and an indoor machine provided with a decompressor and an evaporator, are connected in parallel by piping, comprising:

an oil regulator that adjusts an oil amount to be supplied to said compressor and is disposed between said accumulator and said compressor;

an oil return pipe that returns refrigerator oil stored in said accumulator to said oil regulator, said oil return pipe directly connects said accumulator and said oil regulator;

an oil equalizing pipe that connects said accumulators to each other; and a controller that controls an operation of said compressor and on/off of an electromagnetic valve provided in said oil equalizing pipe, wherein said accumulator is disposed at a downstream side of said evaporator in a refrigerant flow of said refrigerating cycle and at an upstream side of said compressor in the refrigerant flow of said refrigerating cycle, said oil return pipe is provided independent from a refrigerant pipeline of said refrigeration cycle so that the oil return pipe does not include refrigerant gas, said controller executes the operation control in which while all the electromagnetic valves are kept open, a specific compressor is operated at a frequency lower than the other compressors, and the compressor to be operated at the low frequency is alternated every predetermined time so that all the compressors are operated at the low frequency at least once, said controller opens said electromagnetic valve to make amounts of refrigerator oil stored in each of said accumulators equal, and a lowermost portion of the accumulator is disposed at a height not lower than the oil return pipe that connects the accumulator and the oil regulator to each other.

8. The refrigerating device of claim 7, wherein the predetermined height of the end inflow port of the oil equalizing pipe inside the accumulator is at a location corresponding to 40% to 60% of the capacity of the accumulator.

9. The refrigerating device of claim 7, wherein an end inflow port of said oil equalizing pipe is disposed inside said accumulator at a predetermined height from a bottom face of said accumulator.

* * * * *